US009651044B2

(12) United States Patent
Suitou et al.

(10) Patent No.: US 9,651,044 B2
(45) Date of Patent: May 16, 2017

(54) ELECTRIC COMPRESSOR

(71) Applicant: KABUSHIKI KAISHA TOYOTA JIDOSHOKKI, Aichi-ken (JP)

(72) Inventors: Ken Suitou, Aichi-ken (JP); Kazuo Murakami, Aichi-ken (JP); Yoshikazu Fukutani, Aichi-ken (JP); Shinji Tsubai, Aichi-ken (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 205 days.

(21) Appl. No.: 14/591,444

(22) Filed: Jan. 7, 2015

(65) Prior Publication Data

US 2015/0192124 A1 Jul. 9, 2015

(30) Foreign Application Priority Data

Jan. 8, 2014 (JP) ..... 2014-001482

(51) Int. Cl.

| | |
|---|---|
| ***F04C 18/00*** | (2006.01) |
| ***F04C 18/02*** | (2006.01) |
| ***F04C 29/00*** | (2006.01) |
| ***F04C 23/00*** | (2006.01) |
| ***F04C 29/12*** | (2006.01) |
| *F04C 29/04* | (2006.01) |

(Continued)

(52) U.S. Cl.

CPC ..... *F04C 18/0215* (2013.01); *F04C 23/008* (2013.01); *F04C 29/126* (2013.01);

(Continued)

(58) Field of Classification Search

CPC F04C 18/0207; F04C 18/0215; F04C 23/008; F04C 2240/30; F04C 29/0035

(Continued)

(56) References Cited

U.S. PATENT DOCUMENTS 6,599,104 B2 * 7/2003 Saito ..... F04C 29/045 417/366
6,749,404 B2 * 6/2004 Gennami ..... F04C 18/0215 417/212

(Continued)

FOREIGN PATENT DOCUMENTS

| | | |
|---|---|---|
| CN | 102953992 | 3/2013 |
| JP | 7-269475 | 10/1995 |

(Continued)

OTHER PUBLICATIONS

Official Action, along with English-language translation thereof, for CN Appl. No. 201510006009.8 dated Jun. 2, 2016.

(Continued)

*Primary Examiner* — Peter J Bertheaud
(74) *Attorney, Agent, or Firm* — Greenblum & Bernstein, P.L.C.

(57) ABSTRACT

An electric compressor is provided with a compression mechanism, an electric motor, a motor housing, discharge housing and an intermediate pressure housing. The compression mechanism has a compression chamber and is driven by the electric motor. The motor housing accommodates therein the electric motor and the compression mechanism and formed therein an injection port. The discharge housing has therein a discharge chamber into which compressed refrigerant is discharged. The intermediate pressure housing has therein an introduction port for introducing intermediate pressure refrigerant from an external refrigerant circuit and a communication passage that provides communication between the introduction port and the injection port of the motor housing. The motor housing, discharge housing and the intermediate pressure housing has a bolt fastening hole, and a bolt is inserted in the bolt fastening (Continued)

holes to integrally fix the motor housing, discharge housing and the intermediate pressure housing.

4 Claims, 7 Drawing Sheets

(52) U.S. Cl.
CPC ..... *F04C 29/0007* (2013.01); *F04C 29/042* (2013.01); *F04C 2230/60* (2013.01); *F04C 2240/30* (2013.01)

(58) Field of Classification Search
USPC ..... 417/410.5, 410.3, 410.4; 418/55.1
See application file for complete search history.

(56) References Cited

U.S. PATENT DOCUMENTS

| | | | | |
|---|---|---|---|---|
| 7,162,797 | B2 * | 1/2007 | Sowa | F04C 18/0207 29/407.05 |
| 8,007,262 | B2 * | 8/2011 | Ichiyanagi | F04C 18/0215 384/123 |
| 8,162,636 | B2 * | 4/2012 | Yokoi | F04C 18/0215 184/6.17 |
| 8,398,377 | B2 * | 3/2013 | Itabashi | F04C 18/0215 310/43 |
| 2005/0002800 | A1 * | 1/2005 | Kimura | F04B 27/1081 417/321 |
| 2015/0086404 | A1 | 3/2015 | Kiem et al. | |

FOREIGN PATENT DOCUMENTS

| | | |
|---|---|---|
| JP | 08-144971 | 6/1996 |
| JP | 08-303361 | 11/1996 |
| JP | 11-107945 | 4/1999 |
| JP | 2002-174176 | 6/2002 |
| JP | 2007-177674 | 7/2007 |
| KR | 10-2013-0102351 | 9/2013 |

OTHER PUBLICATIONS

Official Action for South Korean Pat. Appl. No. 10-2015-0002071 dated Jun. 20, 2016.

* cited by examiner

ELECTRIC COMPRESSOR

BACKGROUND OF THE INVENTION

The present invention relates generally to an electric compressor and more specifically to an electric compressor that is provided with an injection mechanism.

As a conventional electric compressor, a scroll type compressor such as disclosed in Japanese Patent Application Publication No. H08-303361 is known. The scroll type electric compressor has a power saving mechanism that controls the compression capacity by allowing refrigerant being compressed to flow through a bypass passage toward a low-pressure region of the compressor. The power saving mechanism is provided with a cover plate disposed on the upper surface of a base plate of a fixed scroll member of the compressor. The cover plate has therein a back pressure passage where high pressure refrigerant or low pressure refrigerant is selectively flowed from a unit circuit through a high pressure guide tube and a bypass passage that communicates with the back pressure passage. The bypass passage has a first save-hole, a second save-hole and a return hole. The first save-hole and the second save-hole are formed through the base plate of the fixed scroll member in communication with a compression chamber, and the return hole is also formed through the base plate in communication with a low pressure chamber. The first save-hole, the second save-hole and the return hole are opened to the bypass passage and a first save-valve, a second-save valve and a valve element are provided at the openings of the first save-hole, the second save-hole and the return hole, respectively. The first save-valve, the second-save valve and the valve element are openable/closeable in response to pressure of the refrigerant supplied into the bypass passage.

It is presumed that assembling of the scroll type compressor disclosed in Japanese Patent Application Publication No. H08-303361 is accomplished in the manner described below. Firstly, the cover plate is fixed to the upper surface of the base plate of the fixed scroll member by a bolt. Next, an end cap is mounted so that the cover plate and the base plate of the fixed scroll member are partly covered by the end cap. Then, the high pressure guide pipe, which is connected to a unit circuit, is inserted into a through hole formed through the end cap, and the high pressure guide pipe is connected to the back pressure passage.

However, in order to add a power saving mechanism to the scroll compressor disclosed in the Japanese Patent Publication No. H08-303361, it requires preparing a cover plate having formed therein the bypass passage and the back pressure passage and further having the first saving valve, the second saving valve and the valve element at the openings and forming the first save-hole, the second save-hole and the return hole in the base plate of the fixed scroll member. In addition, a hole needs to be formed through the end cap in which the high pressure pipe is to be inserted. With the opening in the bypass passage aligned properly with the first save-hole, the second save-hole and the return hole, the cover plate is fixed to the upper surface of the base plate of the fixed scroll member by a bolt and the end cap is mounted on the cover plate. Furthermore, the high pressure guide pipe needs to be inserted into the hole formed through the end cap for communication with the back pressure passage. As it is obvious from the above description, adding the power saving mechanism to the scroll type electric compressor requires numerous modifications of parts and increases assembling cost.

The present invention which has been made in light of the problems is directed to providing an electric compressor that can reduce part modification and assembly cost in adding an injection mechanism to the electric compressor.

SUMMARY OF THE INVENTION

In accordance with an aspect of the present invention, there is provided an electric compressor that includes a compression mechanism, an electric motor, a motor housing, discharge housing and an intermediate pressure housing. The compression mechanism has a compression chamber and is driven by the electric motor. The motor housing accommodates therein the electric motor and the compression mechanism and formed therein an injection port. The discharge housing has therein a discharge chamber into which compressed refrigerant is discharged. The intermediate pressure housing has therein an introduction port for introducing intermediate pressure refrigerant from an external refrigerant circuit and a communication passage that provides communication between the introduction port and the injection port of the motor housing. The motor housing, discharge housing and the intermediate pressure housing has a bolt fastening hole, and a bolt is inserted in the bolt fastening holes to integrally fix the motor housing, discharge housing and the intermediate pressure housing.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1:
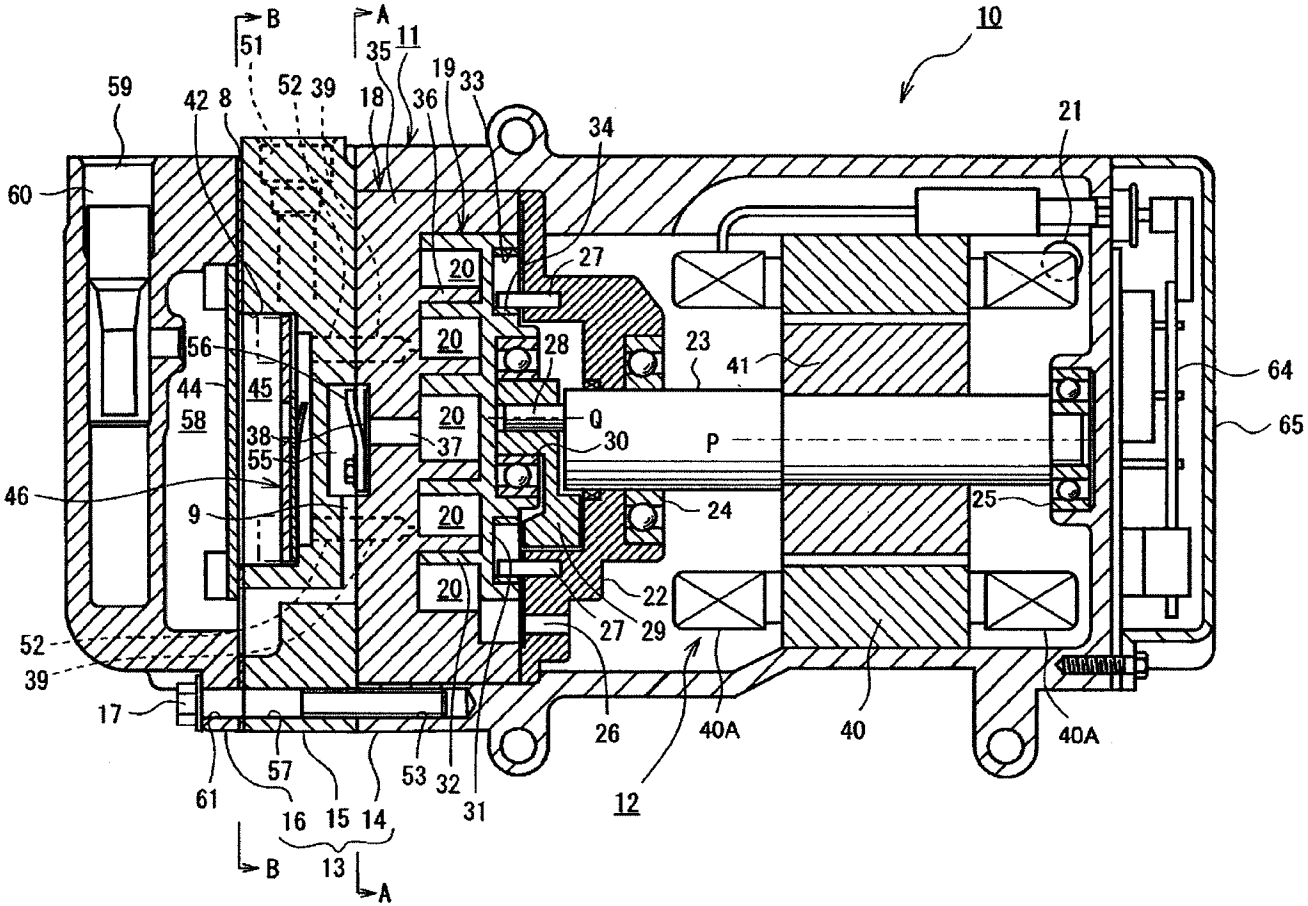
FIG. 1 is a longitudinal sectional view of an electric compressor according to an embodiment of the invention.

The following describes an electric compressor according to an embodiment of the present invention with reference to FIGS. 1 to 5. The electric compressor of this embodiment, which is designated by 10 in FIG. 1, is a scroll type electric compressor for vehicle to be mounted on an electric vehicle (hereinafter referred to as compressor). The compressor 10 forms a part of refrigerant circuit for a vehicle air conditioner.

Referring to FIG. 1, the compressor 10 includes a compression mechanism 11 that compresses a refrigerant and an electric motor 12 that drives the compression mechanism 11.

The compressor 10 further includes a housing 13 having therein the compression mechanism 11 and the electric motor 12. The housing 13 is made of metal material, and it is formed with aluminum alloy in the embodiment. The housing 13 includes a motor housing 14, a valve block 15 and a discharge housing 16. The valve block 15 forms a part of the outer shell of the housing 13 and corresponds to the intermediate pressure housing of the present invention. The motor housing 14, the valve block 15 and the discharge housing 16 are placed side by side and fixed together by bolts 17.

A plurality of screw holes 53 is formed at a side facing the valve block 15 in the motor housing 14 in axial direction of the compressor 10. The screw holes are provided at regular intervals in the circumferential direction of the housing 13. The bolts 17 are to be screwed into the screw holes 53 thereby to fasten the motor housing 14, the valve block 15 and the discharge housing 16 together. The screw holes 53 serve as bolt fastening holes.

The motor housing 14 of the compressor 10 accommodates therein the compression mechanism 11 and the electric motor 12. The compression mechanism 11 includes a fixed scroll member 18 and a movable scroll member 19, which cooperate to form therebetween a compression chamber 20. An inlet port 21 is formed through the motor housing 14. The inlet port 21 is in communication with an external refrigerant circuit (not shown) and, during the operation of the compressor 10, low-pressure refrigerant drawn into the motor housing 14 from the external refrigerant circuit through the inlet port 21.

A shaft support member 22 is provided in the motor housing 14 between the fixed scroll member 18 and the electric motor 12. The electric motor 12 has a rotary shaft 23. The shaft support member 22 forms a part of the compression mechanism 11 and is provided with a bearing 24 that supports one end of a rotary shaft 23. The other end of the rotary shaft 23 is supported by the motor housing 14 through a bearing 25. A suction port 26 is formed through the shaft support member 22 in communication with the compression chamber 20, and the refrigerant drawn into the housing 14 through the inlet port 21 is introduced into the compression chamber 20 through the suction port 26. A fixed side pin 27, which is described later, is press-fit at one end thereof into the shaft support member 22 and the other of end of the fixed side pin 27 extends towards the movable scroll member 19.

An eccentric pin 28 extends from an end of the rotary shaft 23 toward the fixed scroll member 18. The axis Q of the eccentric pin 28 is positioned eccentric to the axis P of the rotary shaft 23, so that the eccentric pin 28 revolves eccentrically with respect to the axis P of the rotary shaft 23 with the rotation of the rotary shaft 23. A drive bushing 29 is fitted on the eccentric pin 28 so as to be rotatable relatively to the eccentric pin 28. The drive bushing 29 has a balancing weight portion that corrects imbalance which is caused by the eccentric revolution of the eccentric pin 28 and the drive bushing 29.

The movable scroll member 19 is rotatably connected to the drive bushing 29 through a bearing 30 for the movable scroll member 19 to make an orbital motion. The movable scroll member 19 includes a disk shaped base plate 31 and a spiral shaped movable scroll wall 32. The base plate 31 of the movable scroll member 19 is arranged perpendicularly to the axis P, and the movable scroll wall 32 is formed extending from the base plate 31 toward the fixed scroll member 18.

A plurality of bottomed circular holes 33 is formed in the base plate 31 at the positions adjacent to the periphery thereof and a rotation prevention ring 34 is inserted in each of the holes 33. The fixed side pins 27 are located at positions corresponding to the positions of the respective holes 33. The fixed side pins 27 are protruded and extend from the shaft support member 22 toward the bottomed circular holes 33 and inserted into the rotation prevention ring 34. In the present embodiment, the rotation prevention rings 34 and the fixed side pins 27 cooperate to constitute a rotation preventing mechanism that prevents the rotation of the movable scroll member 19. Accordingly, the movable scroll member 19 orbits around the axis P without rotating on its own axis with the rotation of the rotary shaft 23.

The fixed scroll member 18 is fixedly mounted in the motor housing 14 in engagement with the movable scroll member 19 in facing relation to each other. The fixed scroll member 18 includes a disk-shaped base plate 35 and a spiral shaped scroll wall 36 formed integrally with and extending from the base plate 35 toward the movable scroll member 19. The base plate 35 is disposed so as to close the end of the motor housing 14. The base plate 35 of the fixed scroll member 18 forms a part of the motor housing 14.

Figure 2:
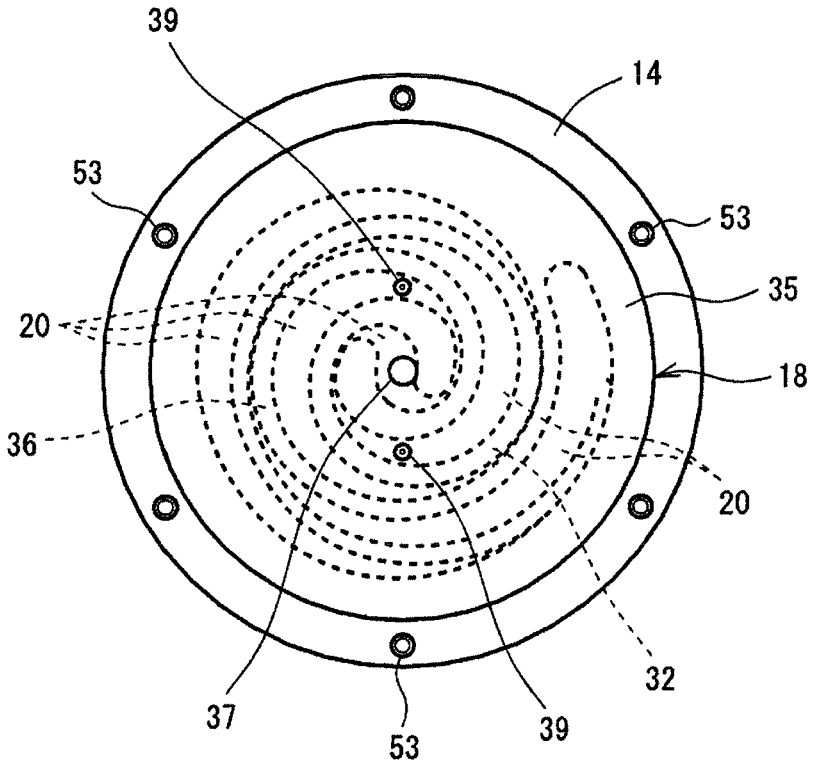
FIG. 2 is a traverse cross-sectional view of the electric compressor taken along line A-A of FIG. 1.

The compression chamber 20 is formed between the scroll wall 36 of the fixed scroll member 18 and the scroll wall 32 of the movable scroll member 19 that are in contact with each other. As shown in FIG. 2, two compression chambers 20 having therein the same inside pressure and the same volume are formed simultaneously. Refrigerant is introduced through the suction port 26 into two compression chambers 20 that are formed in outer peripheral region. As the two compression chambers 20 moves inwardly in accordance with the orbiting motion of the movable scroll member 19, refrigerant in the compression chamber 20 is compressed with a decrease of the volume of the compression chambers 20. A discharge port 37 is formed in the base plate 35 of the fixed scroll member 18 at the center thereof in communication with a discharge chamber 58. The discharge port 37 is provided with a discharge valve 38 that opens and closes the discharge port 37 and a retainer 56 that regulates the opening of the discharge valve 38. The discharge valve 38 opens when the pressure of the refrigerant in the compression chamber 20 exceeds a predetermined level.

As shown in FIGS. 1 and 2, two injection ports 39 are formed in the base plate 35 of the fixed scroll member 18 at positions that are radially outward of the discharge port 37. Each injection port 39 is in communication with the compression chamber 20 during the compression and opened to face the valve block 15. The injection port 39 serves as passages to introduce intermediate pressure refrigerant into the compression chamber 20. The injection port 39 is formed smaller in diameter at the end thereof adjacent to the movable scroll member 19 than the opposite end adjacent to the valve block 15, so that the small diameter end of the injection port 39 serves as the nozzle to inject intermediate pressure refrigerant into the compression chamber 20.

The electric motor 12 includes a stator 40 that is fixed to the inner periphery of the motor housing 14 and a rotor 41 that is inserted in the stator 40 and fixed on the rotary shaft 23. The compressor 10 is provided with a driving circuit case 65 that is attached to the motor housing 14. The driving circuit case 65 has therein a driving circuit 64 for driving electric motor 12. The driving circuit 64 supplies three-phase AC power to a coil 40A of the stator 40 and the rotor 41 is driven to rotate in the stator 40, accordingly. With the rotation of the rotor 41, the compression mechanism 11 connected to the rotary shaft 23 is operated for compression of refrigerant.

Figure 3:
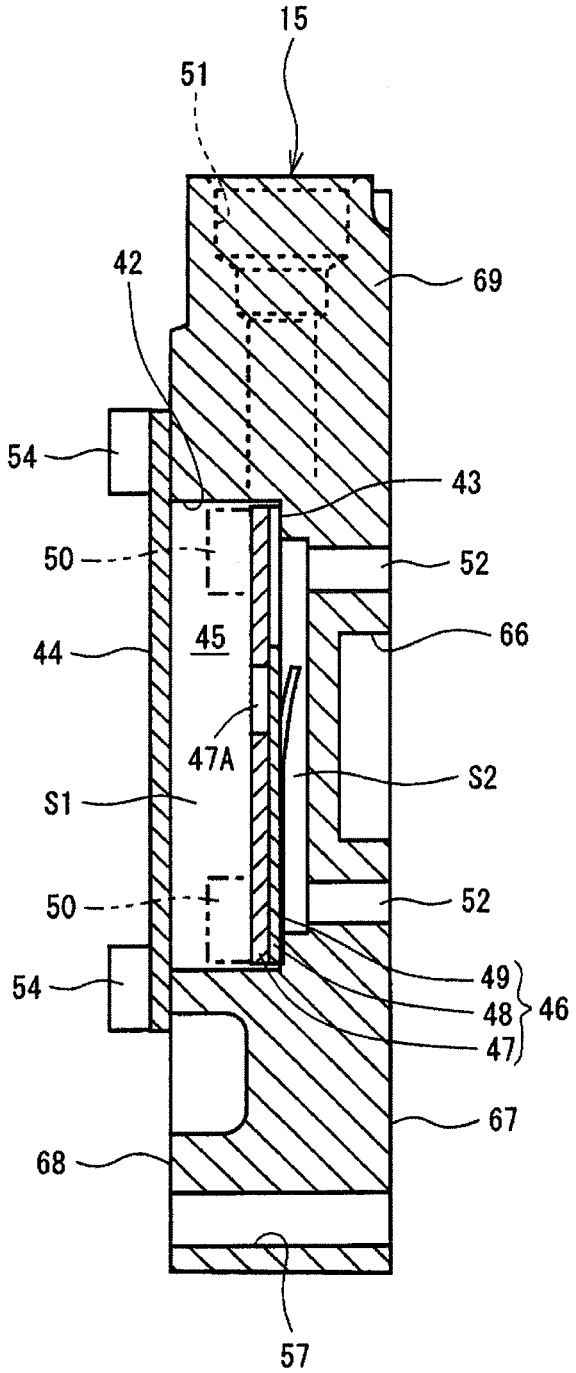
FIG. 3 is an enlarged cross-sectional view of a valve block shown in the FIG. 1.
Figure 4:
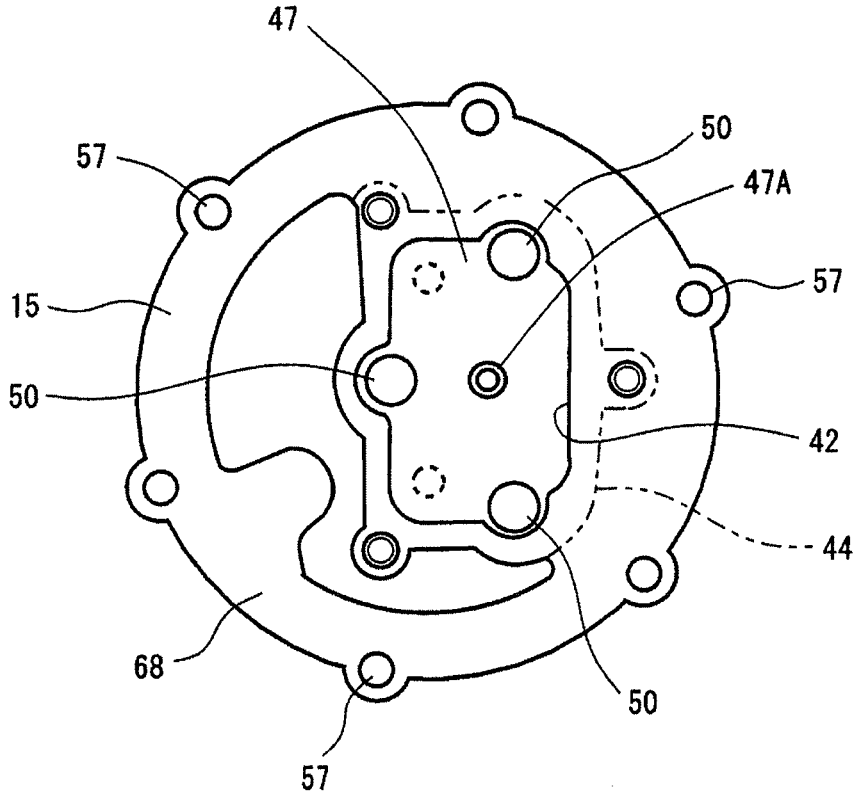
FIG. 4 is a traverse cross-sectional view of the electric compressor taken along B-B line of FIG. 1.

As shown in FIGS. 1 and 3, the valve block 15 has a cylindrical shape and a predetermined thickness in the axial direction. The valve block 15 is made of aluminum-based metal material. As shown in the FIG. 3, the valve block 15 has a front surface 67 that faces the motor housing 14, a rear surface 68 that faces the discharge housing 16 and a peripheral wall 69 that is formed between the front surface 67 and the rear surface 68. As shown in FIGS. 3 and 4, a rectangular recess 42 which is formed in the valve block 15 at the radial center thereof and opened toward the discharge housing 16. The recess 42 is formed with a step 43 at a position adjacent to the bottom of the recess 42, having a large diameter part and a small diameter part. The recess 42 is closed by a cover plate 44 which serves as cover member in the present invention, so that an injection chamber 45 is defined by the recess 42 and the cover plate 44. The cover plate 44 is fixed to the valve block 15 with a plurality of bolts 54.

The injection chamber 45 is provided with a check valve 46. The check valve 46 includes a valve plate 47 having formed therethrough a hole 47A, a reed valve 48 which is arranged so as to close the hole 47A and a retainer 49 which restricts the movement of the reed valve 48. The check valve 46 is fixed to the step 43 of the injection chamber 45 with bolts 50 in the state that the valve plate 47, the reed valve 48 and the retainer 49 are stacked. The injection chamber 45 is divided into two spaces by the check valve 46. The space formed on the side of discharge housing 16 is indicated by S1 and the space formed on the side of motor housing 14 is indicated by S2.

An introduction port 51 is formed in the valve block 15 and opened at the outer peripheral surface of the peripheral wall 69 thereof. The introduction port 51 communicates with the space S1 of the injection chamber 45. The introduction port 51 is an introduction passage where intermediate pressure refrigerant is flowed from the external refrigerant circuit (not illustrated) and introduced to the injection chamber 45. The intermediate pressure refrigerant means the refrigerant having a pressure that is higher than suction pressure introduced through the inlet port 21 and lower than discharge pressure discharged through the discharge port 37. The suction pressure corresponds to the pressure of the drawn refrigerant, that is the pressure of the refrigerant drawn into the motor housing before being compressed by the compression mechanism, and the discharge pressure corresponds to a pressure of the compressed refrigerant discharged into the discharge chamber in the present invention.

Two supply ports 52 are formed in the valve block 15 at the periphery of the bottom portion of the recess 42 for providing fluid communication between the injection chambers 45 and the injection ports 39 formed in the fixed scroll member 18. The supply ports 52 are in communication with the space S2 of the injection chamber 45. When the intermediate pressure refrigerant is introduced into the space S1 of the injection chamber 45 via the introduction port 51, the reed valve 48 is bent by the pressure of the refrigerant in the direction that opens the hole 47A. With the check valve 46 thus opened, the intermediate pressure refrigerant in the injection chamber 45(S1) is supplied into the compression chamber 20 through the space S2 of the injection chamber 45, the supply port 52 and the injection port 39. The injection chamber 45 (S1), the injection chamber 45 (S2) and the supply port 52 cooperate to form a communication passage between the introduction port 51 and the injection port 39 of the present invention. The introduction port 51 and the communication passage cooperate with the injection port 39 to allow the intermediate pressure refrigerant to be injected into the compression chamber 20. In the middle of the communication passage, the injection chamber 45 where the volume is enlarged is provided. In other words, the volume of the injection chamber 45 is larger than the volume of communication passage other than the injection chamber 45. Or, the diameter of the injection chamber 45 is larger than the diameter of communication passage other than the injection chamber 45.

A recess 66 is formed in the valve block 15 on the side thereof opposite from the injection chamber 45 and opened to the discharge port 37. A discharge valve chamber 55 is formed by closing the recess 66 by the fixed scroll member 18. The discharge valve chamber 55 accommodates therein a discharge valve 38 that opens the discharge port 37 and a retainer 56. In addition, a passage 9 (refer to FIG.1) is formed in the valve block 15 which provides fluid communication between the discharge valve chamber 55 and a discharge chamber 58 that is formed in the discharge housing 16. A plurality of through holes 57 in which the bolts 17 are to be inserted are formed on the outer periphery of the valve block 15 in the axial direction of the compressor 10. The through holes 57 are disposed at regular intervals in the circumference corresponding to the positions of screw holes 53 of the motor housing 14. The through holes 57 serve as bolt fastening holes. As described above, the injection mechanism having the introduction port 51, the injection chamber 45, the check valve 46 and the supply port 52 is assembled on the valve block 15. The injection mechanism indicates a mechanism that introduces intermediate pressure refrigerant, i.e. refrigerant having a pressure that is higher than the pressure of the drawn refrigerant, that is the pressure of the refrigerant drawn into the motor housing before being compressed by the compression mechanism, and lower than the pressure of the compressed refrigerant in the compression chamber 20 during the compression.

The discharge chamber 58 that is in communication with the discharge valve chamber 55 is formed in the discharge housing 16. A discharge port 60 is also formed in the discharge housing 16, and a discharge outlet 59 is formed opened at the outer periphery of the discharge port 60. The discharge exit 59 is connected to an external refrigerant circuit (not illustrated). The discharge housing 16 has therein a passage for communication between the discharge chamber 58 and the discharge port 60.

Figure 5:
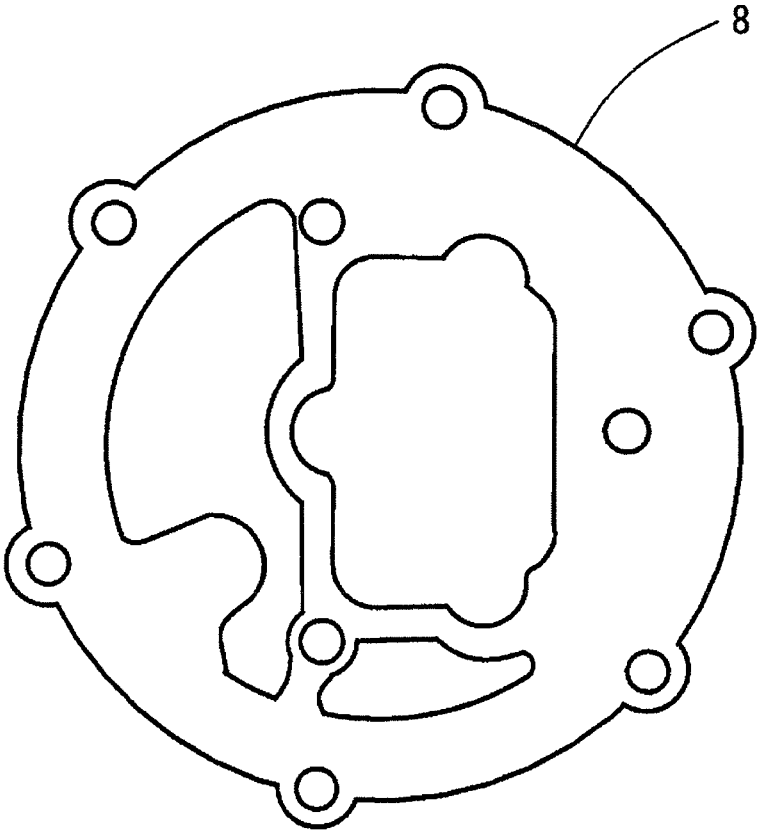
FIG. 5 is a plan view of a gasket.

The discharge chamber 58 and the injection chamber 45 are formed on the opposite sides of the cover plate 44. In other words, the injection chamber 45 is located across the cover plate 44 from the discharge chamber 58. Thus, the cover plate 44 serves as a partition between the discharge chamber 58 and the injection chamber 45. The discharge chamber 58 communicates with the discharge valve chamber 55 through the passage 9 provided on the valve block 15. Referring to FIGS. 1 and 5, a gasket 8 is provided for sealing between the valve block 15 and the discharge housing 16, thus making a seal between the injection chamber 45 and the discharge chamber 58. A plurality of through holes 61 into which the bolts 17 are to be inserted are formed on the outer periphery of the discharge housing 16 in the axial direction of the compressor 10. The holes 61 are provided at regular intervals in the circumference corresponding to the positions of screw holes 53 of the motor housing 14. The through holes 61 serve as bolt fastening holes.

The following will describes the operation of the compressor 10 having the above described configuration. The rotary shaft 23 is driven to rotate when electric power is supplied from the driving circuit 64, and the rotation is transmitted to the movable scroll member 19 of the compression mechanism 11 through the eccentric pin 28 and the drive bushing 29. The movable scroll member 19 orbits while being prevented from rotating on its own axis by the rotation preventing mechanism that includes the rotation prevention ring 34 and the fixed side pin 27. With such orbiting motion of the movable scroll member 19, the compression chambers 20 formed between the movable scroll member 19 and the fixed scroll member 18 moves toward the center of the scroll members 18, 19 while reducing its volume.

The refrigerant which has been drawn into the motor housing 14 through the inlet port 21 and then introduced into the compression chamber 20 through the suction port 26 is compressed with the reduction of the volume of the compression chamber 20. The refrigerant compressed in the compression chamber 20 pushes open the discharge valve 38 and the refrigerant is discharged in the discharge valve chamber 55 through the discharge port 37 and the discharge valve 38 and then into the discharge chamber 58. The high pressure refrigerant thus discharged into the discharge chamber 58 is delivered to the external refrigerant circuit through the discharge exit 59.

Intermediate pressure refrigerant introduced into the space S1 of the injection chamber 45 via the introduction port 51 pushes open the reed valve 48 of the check valve 46. Consequently, the intermediate pressure refrigerant is flowed through the space S2 of the injection chamber 45, the supply port 52 and the injection port 39 and supplied into the compression chamber 20 that is then compressed during the compression. At this time, the pressure of the refrigerant being compressed in the compression chamber 20 is lower than that of the intermediate pressure refrigerant. The intermediate pressure refrigerant is supplied into the compression chamber 20 after the pressure pulsation (pressure fluctuation) of the refrigerant in the injection chamber 45 has been reduced. The compression efficiency of the compressor 10 is increased by supplying the intermediate pressure refrigerant into the compression chamber 20. When the pressure of the refrigerant in the compression chambers 20 becomes higher than that of the intermediate pressure refrigerant in the injection chamber 45, the check valve 46 is closed and the supply of the intermediate pressure refrigerant is stopped. The check valve 46 thus prevents the backflow of refrigerant from the compression chamber 20.

Figure 6B:
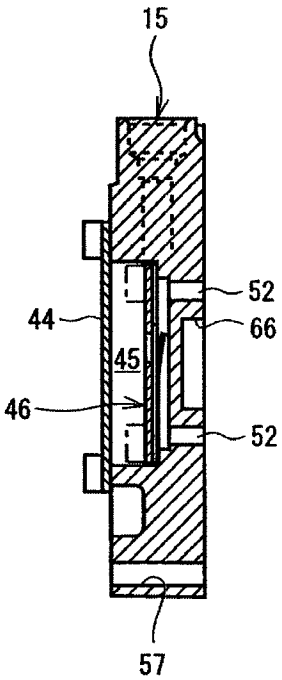
FIG. 6B is a longitudinal sectional view showing a valve block in which an injection mechanism is incorporated.
Figure 6A:
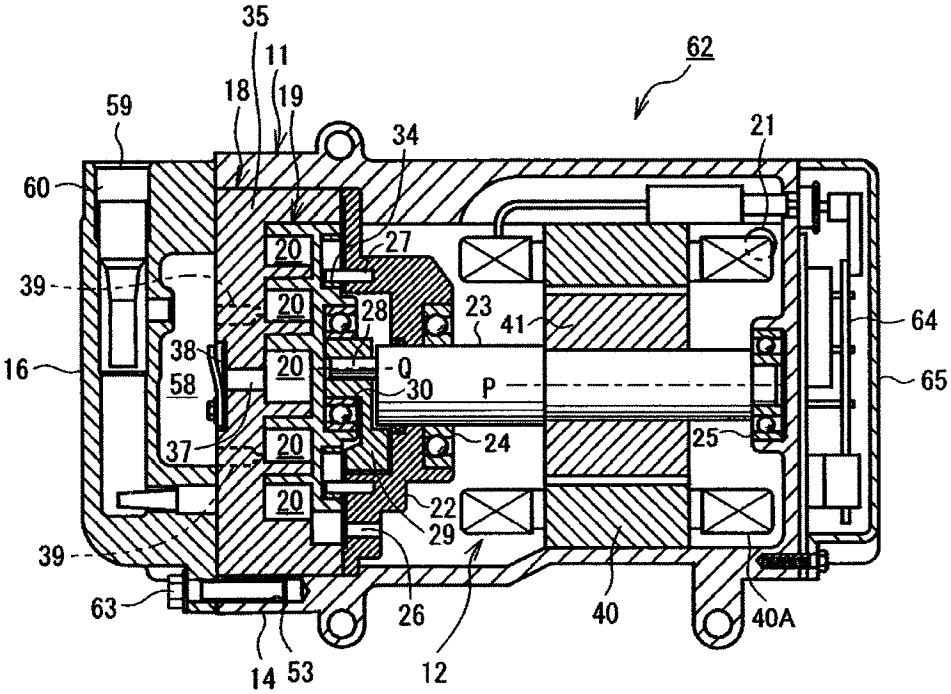
FIG. 6A is a longitudinal sectional view showing an electric compressor having no injection mechanism.

The following will describes a procedure for adding an injection mechanism to a compressor having no injection mechanism. A compressor 62 shown in the FIG. 6A is a scroll type compressor having no injection mechanism. The compressor 62 includes a motor housing 14 accommodating therein a compression mechanism 11 and an electric motor 12 and a discharge housing 16. The motor housing 14 and the discharge housing 16 are fixed together by bolts 63. In other words, the compressor 62 has a structure of the compressor 10 of the FIG. 1 with the valve block 15 removed. Same reference numerals are used in the description of the compressor 62 to denote the parts or elements that are common to the compressors 10 and 62 and, therefore, the description of such common parts or elements will be omitted. The base plate 35 of the fixed scroll member 18 of the compressor 62 has no injection port 39.

For adding an injection mechanism to the compressor 62, the following steps will be taken. First, the bolts 63 are removed from the compressor 62 and the discharge housing 16 is taken out. Then, two injection ports 39 which communicate with compression chambers 20 and are opened to the discharge chamber 58 are formed in the base plate 35 of the fixed scroll member 18 at positions radially outward of the discharge port 37. The locations where injection ports 39 will be formed are indicated by chain line in FIG. 6A. Next, the valve block 15 having incorporated therein the injection mechanism as shown in the FIG. 6B is prepared.

Then, the valve block 15 is arranged between the motor housing 14 and the discharge housing 16. After positioning the valve block 15 correctly, the motor housing 14, the valve block 15 and the discharge housing 16 are fastened together by the bolts 17 in the same manner as in the case of the compressor 10 in FIG. 1.

The followings will describe effects of the compressor 10 according to the above described embodiment. In adding the injection mechanism to the compressor 62 having no injection mechanism, injection ports 39 are bored by machining in the base plate 35 of the fixed scroll member 18 and the valve block 15 having incorporated therein the injection mechanism is prepared. Then, the valve block 15 is arranged between the motor housing 14 and the discharge housing 16, and the motor housing 14, the valve block 15 and the discharge housing 16 are fastened together so that the valve block 15 forms a part of the housing 13 of the compressor 10. Such addition of the injection mechanism to the compressor 62 enables to reduce modification of parts and assembling cost associated with the addition of the injection mechanism to the compressor, as compared with the conventional art.

The compressor 10 equipped with an injection mechanism can be manufactured by adding the injection mechanism to the existing compressor 62 which does not have injection mechanism. Therefore, it is advantageous in manufacturing cost because it does not require to produce the compressor 10 equipped with injection mechanism newly.

The provision of the injection chamber 45 in the compressor 10 serves to reduce the pressure pulsation (pressure fluctuation) of the intermediate pressure refrigerant introduced into the injection chamber 45 through the introduction port 51. Because intermediate pressure refrigerant whose pressure pulsation has been reduced is supplied into the compression chamber 20, the fluctuation in volume of refrigerant supply due to the pressure pulsation may be prevented, which helps to increase compression efficiency of the compressor further.

Since the injection chamber 45 and the discharge chamber 58 are formed on the opposite sides of the cover plate 44, an adequate space is secured in the discharge chamber 58. This enables to reduce the pressure pulsation of the refrigerant being discharged into the discharge chamber 58.

The introduction port 51 which is formed in the valve block 15 may be opened at any position on the peripheral wall 69 of the valve block 15. For example, the position of the opening of the introduction port 51 can be changed easily depending on the vehicle on which the compressor 10 is to be mounted.

The gasket 8 that makes a seal between the valve block 15 and the discharge housing 16 also makes a seal between the injection chamber 45 and the discharge chamber 58. Since it is not necessary to provide a separate sealing between the injection chamber 45 and the discharge chamber 58, the number of parts for the compressor may be reduced.

The present invention is not limited to the above described embodiment but various modifications made be made within the scope of the invention, as exemplified below.

Although the valve block 15 is arranged between the motor housing 14 and the discharge housing 16 in this embodiment, the positions of the valve block 15 and the discharge housing 16 may be changed with each other.

Figure 7:
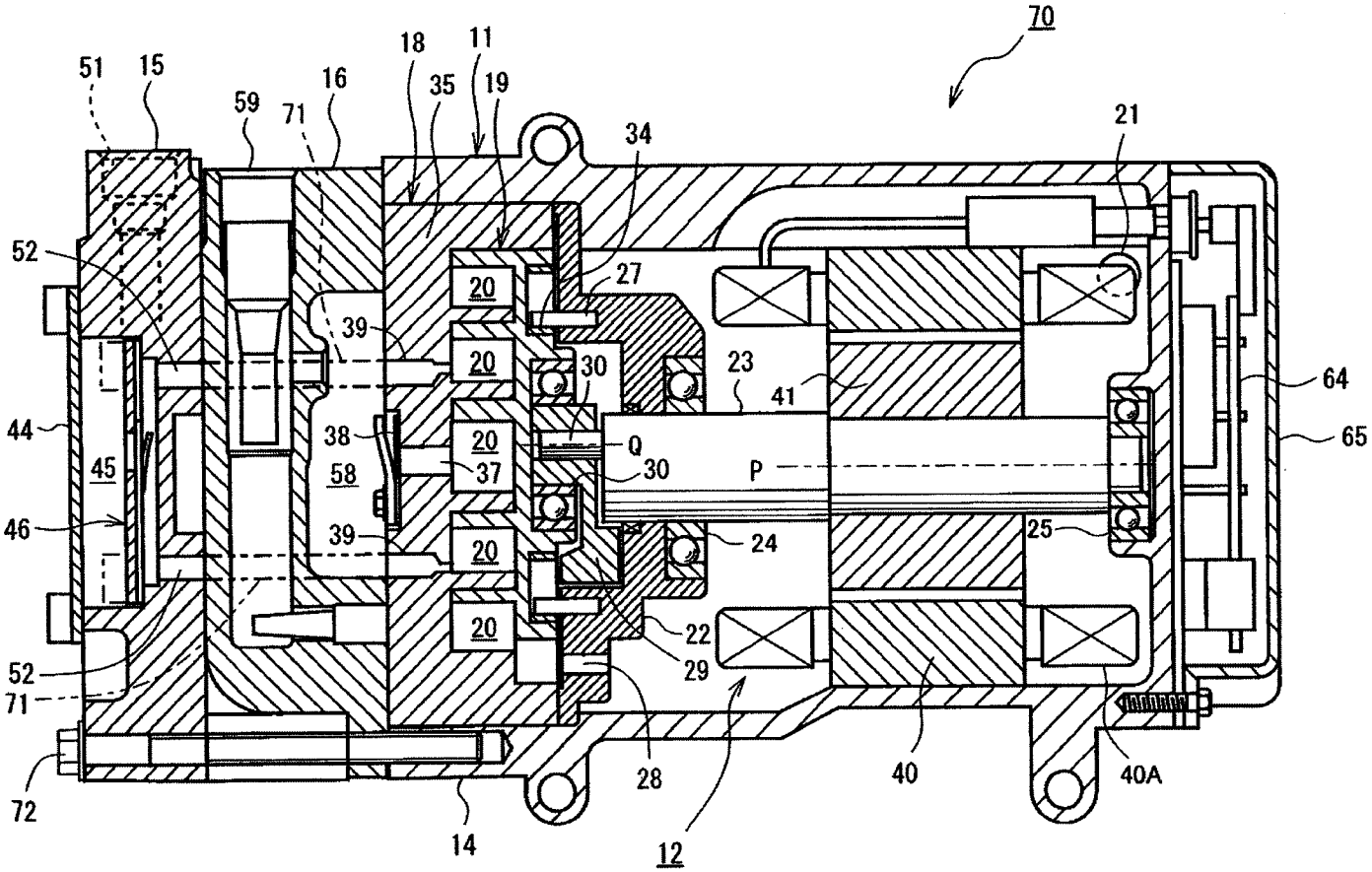
FIG. 7 is a longitudinal sectional view of an electric compressor in another embodiment.

Referring to FIG. 7 showing a compressor 70, the discharge housing 16 is arranged between the motor housing 14 and the valve block 15, and these three members are fixed together by bolts 72. In such case, a passage 71 needs to be formed in the discharge housing 16 for communication between the supply port 52 and the injection ports 39.

Although it has been described that the valve block 15 is mounted to the compressor 62 after the injection ports 39 have been formed in the base plate 35 of the fixed scroll member 18, the injection ports 39 may be formed in the base plate 35 during the production of the compressor 62. When the compressor 62 is used as a compressor without the injection mechanism, the injection ports 39 may be blocked, for example, by inserting a plug. When it is used as a compressor having an injection mechanism, the plug is removed. In this case, no process required to add the injection port 39, so that the assembly of the compressor may be simplified further.

Although the check valve 46 is provided in the injection chamber 45, the check valve may be formed in each of the supply ports 52.

The check valve 46 does not need to be formed if the pressure of the intermediate pressure refrigerant in the injection chamber 45 is always higher than that of the refrigerant in the compression chamber 20 at the time of injection.

What is claimed is:

1. An electric compressor comprising:

a compression mechanism having a compression chamber;

an electric motor driving the compression mechanism to draw a drawn refrigerant into the motor housing, the drawn refrigerant is suctioned into the compression chamber and compressed in the compression chamber;

a motor housing accommodating the electric motor and the compression mechanism, the motor housing having an injection port that communicates with the compression chamber during compression;

a discharge housing having a discharge chamber into which compressed refrigerant, which is refrigerant that has been compressed in the compression chamber, is discharged; and an intermediate pressure housing having an introduction port for introducing intermediate pressure refrigerant from an external refrigerant circuit and a communication passage that provides communication between the introduction port and the injection port, the introduction port and the communication passage cooperating with the injection port to allow the intermediate pressure refrigerant to be injected into the compression chamber during compression, wherein a pressure of the intermediate pressure refrigerant is higher than a pressure of the drawn refrigerant and lower than a pressure of the compressed refrigerant discharged into the discharge chamber, the motor housing, the discharge housing and the intermediate pressure housing are arranged side by side, each of the motor housing, the discharge housing and the intermediate pressure housing have a bolt fastening hole, a bolt is inserted in the bolt fastening hole of the motor housing, the discharge housing and the intermediate pressure housing, and, the motor housing, the discharge housing and the intermediate pressure housing are integrally fixed by the bolt, the communication passage includes an injection chamber for reducing pressure pulsation of the intermediate pressure refrigerant, the injection chamber is provided adjacent to the discharge chamber, and a cover plate is provided between, and serves as a partition of, the injection chamber and the discharge chamber.

2. The electric compressor according to claim 1, wherein the intermediate pressure housing is arranged between the motor housing and the discharge housing.

3. The electric compressor according to claim 1, wherein the intermediate pressure housing has a front surface facing the motor housing, a rear surface facing the discharge housing and a peripheral wall provided between the front surface and the rear surface, and the introduction port is arranged in the peripheral wall.

4. The electric compressor according to claim 1, further comprising:

a gasket that provides a seal between the intermediate pressure housing and the discharge housing and that further provides a seal between the injection chamber and the discharge chamber.

* * * * *